US005924217A

United States Patent [19]

Peeters

[11] Patent Number: 5,924,217

[45] Date of Patent: Jul. 20, 1999

[54] LIQUID REMOVAL CONVEYOR SYSTEM AND METHOD

[75] Inventor: Huub Peeters, Haggelsom, Netherlands

[73] Assignee: Rey Industries, Inc., Boise, Id.

[21] Appl. No.: 08/828,876

[22] Filed: Mar. 31, 1997

Related U.S. Application Data

[51] Int. Cl.[6] ..... F26B 11/02

[52] U.S. Cl. ..... 34/581; 34/236; 34/401; 34/429

[58] Field of Search ..... 34/401, 429, 236, 34/241, 397, 224, 581, 580

[56] References Cited

U.S. PATENT DOCUMENTS

| | | | |
|---|---|---|---|
| 2,577,525 | 12/1951 | Johnston | 171/127 |
| 3,159,270 | 12/1964 | Johnston | 209/308 |
| 4,045,879 | 9/1977 | Witte | 34/401 |
| 4,251,895 | 2/1981 | Caridis et al. | 15/3.13 |
| 4,370,225 | 1/1983 | Bingel et al. | 209/40 |
| 5,097,755 | 3/1992 | Hill | 99/484 |
| 5,517,906 | 5/1996 | Zittel et al. | 99/536 |

OTHER PUBLICATIONS

Reyco Systems, "Oil Removal and Recovery for the Food Processing Industry" folder. Aug. 1985.

Reyco Systems, "WaterVac Water Removal Systems for the Food Processing Industry" Pamphlet., Jan. 1990.

*Primary Examiner*—Henry Bennett

*Assistant Examiner*—Pamela A. Wilson

*Attorney, Agent, or Firm*—Ormiston Korfanta & Holland, PLLC

[57] ABSTRACT

A liquid removal conveyor system that includes a liquid permeable conveyor belt, a vertically movable agitator and an air suction plenum. The agitator is positioned below and adjacent to the conveyor belt so that, when the agitator moves up and down, it intermittently deflects the conveyor belt. The air suction plenum is positioned below and adjacent to the conveyor belt near the agitator. As the agitator intermittently deflects the conveyor belt, it jostles the material carried on the conveyor belt and the air suction plenum sucks the liquid off the jostled material. The agitator consists of a rotatable shaft and a lobe attached to the shaft. As the shaft rotates, the lobe intermittently deflects the conveyor belt. The agitator lobe may be constructed as a single elongated member that extends across substantially the full width of the conveyor belt, or it may be constructed as two or more discontinuous segments. The lobe may be variously configured as a single lobe projecting from the shaft, a pair of opposing lobes or even a quad of lobes spaced about the perimeter of the shaft.

24 Claims, 10 Drawing Sheets

LIQUID REMOVAL CONVEYOR SYSTEM AND METHOD

FIELD OF THE INVENTION

The invention relates generally to a conveyor based liquid removal system and, more particularly, to a liquid removal conveyor system used in processing food products.

BACKGROUND OF THE INVENTION

The growing popularity of prepared foods, particularly fresh produce and frozen and dried foods, has expanded the need for improved food processing equipment. Processing fresh foods commonly involves cleaning, dewatering and drying the foods before they undergo further processing and packaging. Conventional conveyor based dewatering systems used in the food processing industry draw water off the food products as they travel down a conveyor belt. The WaterVac® water removal systems sold by Rey Industries, Inc., the owner of the present invention, utilize one or more suction plenums placed directly under the dewatering conveyor belt to draw water off a variety of food products. The WaterVac® system may also include a blower or pressurized plenum above the conveyor belt opposite the suction plenum to facilitate the removal of water from the food products.

The apparatus for preparing raw potato slices described in U.S. Pat. No. 4,251,895 issued to Caridis et al., uses an air pressure plenum located above the conveyor belt in conjunction with air suction below the belt to remove water and unwanted particles from potato slices. The air pressure plenum described in the Caridis patent is designed to supply a "blast" of air against the conveyor belt through slit orifices by the side walls of the plenum and a baffle plate. This blast of air is said to place the potato slices in a turbulent or dancing state to facilitate the removal of potato particles from the slices and from the atmosphere around the slices as they are driven airborne. While such a system may tend to improve the dewatering process for potato slices, the use of a high velocity blast of air is not well suited to more light weight or fragile food products.

The present invention was developed as part of an effort to improve conventional processes for dewatering fresh cut lettuce after it has been washed.

Presently, lettuce is spin dried in large centrifugal spin tanks. Spin drying tends to bruise the lettuce. This bruising, in turn, accelerates the rate at which the lettuce degrades and accounts for much of the brown lettuce seen in the bags of fresh cut lettuce in grocery stores.

SUMMARY OF THE INVENTION

The present invention is directed to a liquid removal conveyor system that includes a liquid permeable conveyor belt, a vertically movable agitator and an air suction plenum. The agitator is positioned below and adjacent to the conveyor belt so that, when the agitator moves up and down, it intermittently deflects the conveyor belt. The air suction plenum is positioned below and adjacent to the conveyor belt near the agitator. As the agitator intermittently deflects the conveyor belt, it jostles the material carried on the conveyor belt and the air suction plenum sucks the liquid off the jostled material.

In one embodiment of the invention, the agitator consists of a rotatable shaft and a lobe attached to the shaft. As the shaft rotates, the lobe intermittently deflects the conveyor belt. The agitator lobe may be constructed as a single elongated member that extends across substantially the full width of the conveyor belt, or it may be constructed as two or more discontinuous segments. The lobe may be variously configured as a single lobe projecting from the shaft, a pair of opposing lobes or even a quad of lobes spaced about the perimeter of the shaft.

In another embodiment, the system uses a pair of plenums positioned opposite one another on the upstream and downstream sides of the agitator. In one preferred embodiment of the invention, the agitator shaft is mounted to an adjustable support member that is operative to vary the vertical position of the shaft in relation to the conveyor belt. In this way, the degree of deflection of the conveyor belt can be adjusted to accommodate the different types of material from which liquid is being removed, the type of liquid being removed or other environmental and operating conditions.

These and other features of the invention will become better understood with reference to the following description, the claims and the accompanying drawings.

DETAILED DESCRIPTION OF THE INVENTION

Figure 1:
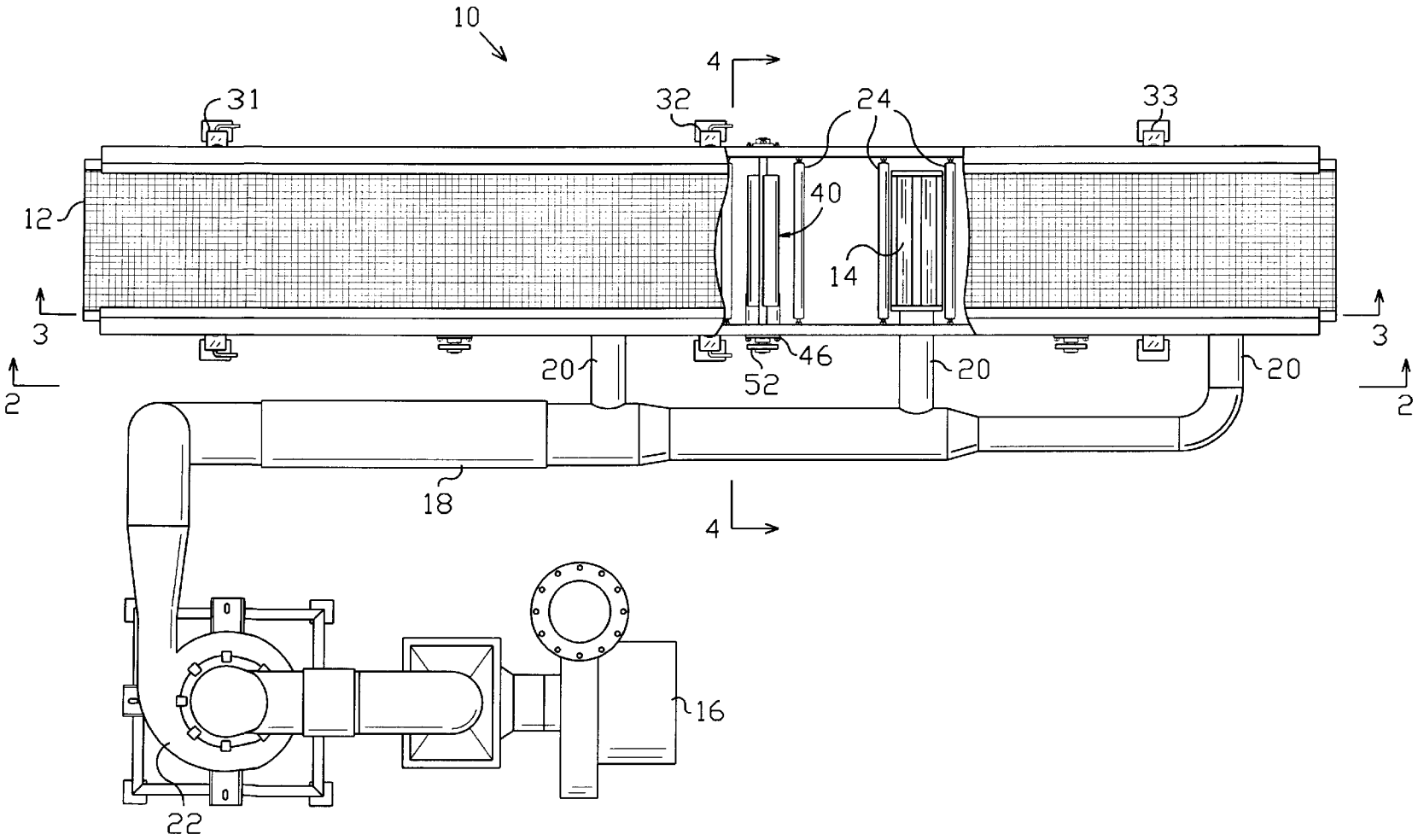
FIG. 1 is a top down plan view of one embodiment of the liquid removal conveyor system, including a cut-away partial view of one of the agitators and one of the air suction plenums.
Figure 2:
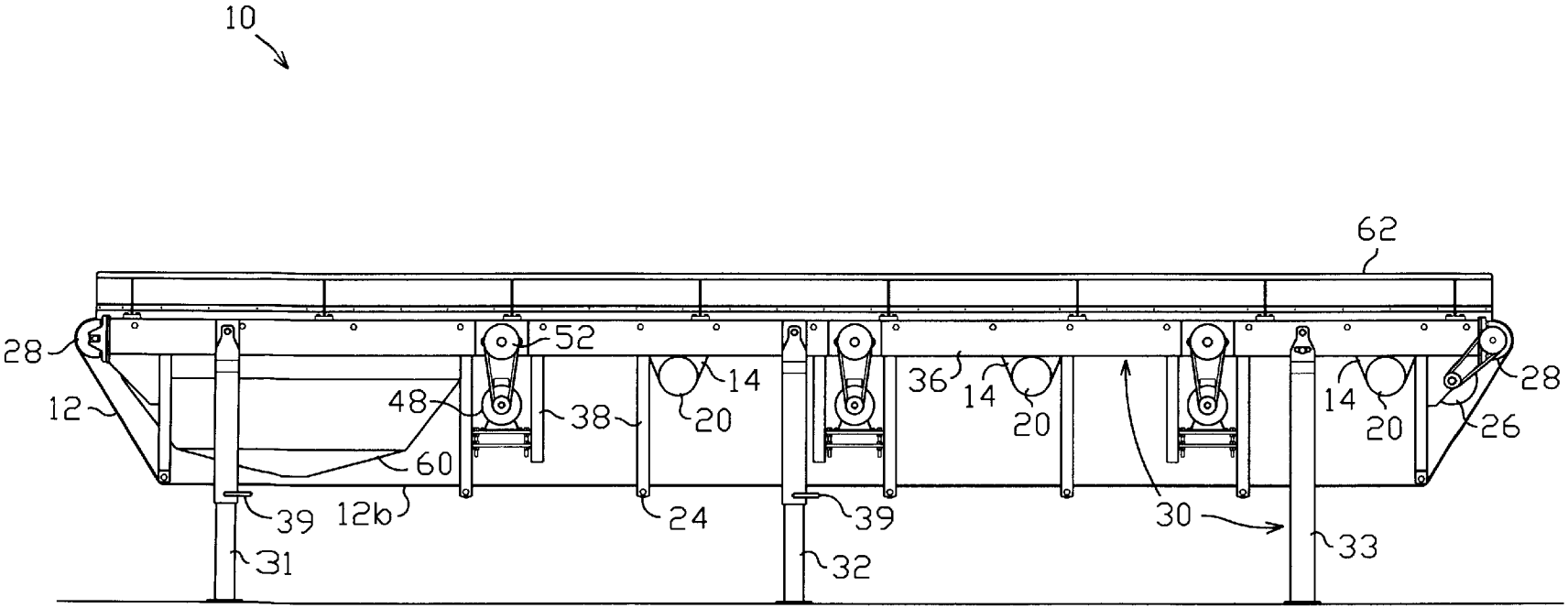
FIG. 2 is an elevation side view along the line 2—2 in FIG. 1.
Figure 3:
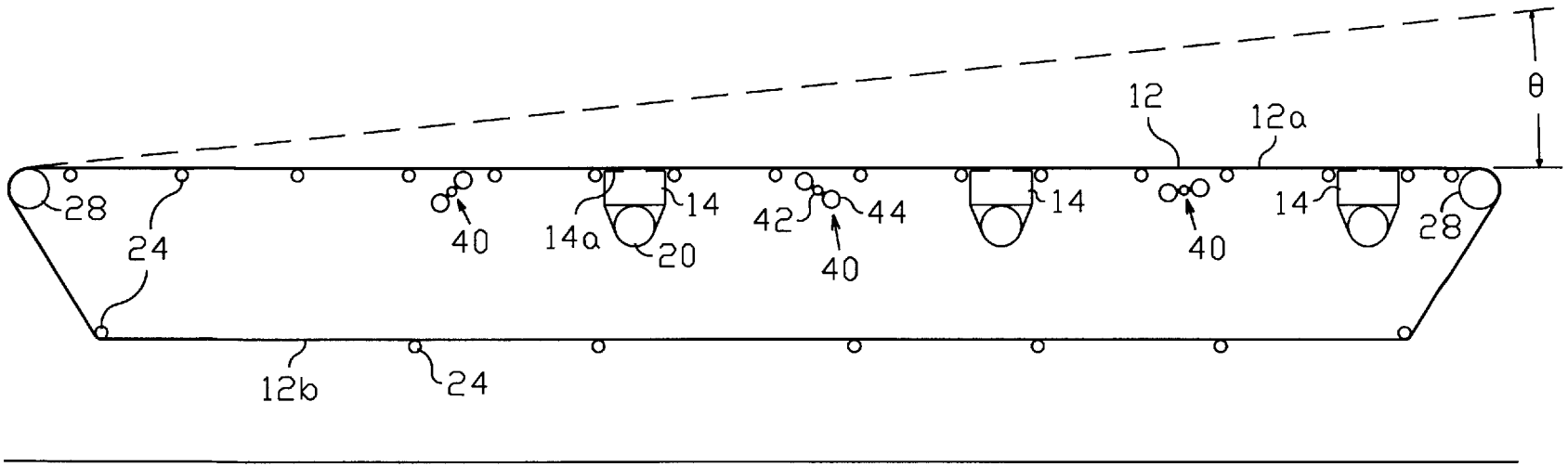
FIG. 3 is an elevation cross section view taken along the line 3—3 in FIG. 1.

Referring to FIGS. 1–6, the liquid removal conveyor system, designated generally by reference number 10, includes conveyor belt 12, air suction plenums 14, and blower 16. Each suction plenum 14 is connected to blower 16 through main duct 18 and connector ducts 20. A cyclone 22 is installed between blower 16 and suction plenums 14 to remove the water or other liquids entrained in the air evacuated through plenums 14 from around conveyor belt 12. Conveyor belt 12 is supported by a series of idler rollers 24 and on the face 14*a* of suction plenums 14. Liquid is drawn off material carried on converyor belt 12 through an adjustable width slot 14*b* in face 14*a* of plenum 14. Conveyor belt 12 is driven by a variable speed motor 26 through drum roller 28. Any suitable combination of belts, chains, pulleys, sprockets and/or gears may be used to construct the operative drive train connection between motor 26 and conveyor belt 12.

Conveyor belt 12 is mounted on and supported by frame 30. Frame 30 includes stanchions 31, 32 and 33, cross braces 34 (shown in FIG. 4) extending laterally between stanchions 32, and stringers 36 extending longitudinally between stanchions 32. The idler rollers 24 that support the upper reach 12*a* of conveyor belt 12 and the suction plenums 14 are mounted to stringers 36. The idler rollers 24 that support the lower reach 12*b* of conveyor belt 12 are mounted to vertical braces 38 that extend down from stringers 36.

Conveyor belt 12 is adjustable to incline at an angle θ. Preferably, the angle of incline θ is in the range of 0–8° . Jacks 39 are used to adjust the incline of conveyor belt 12 by increasing or decreasing the height of the first two stanchions 31 and 32. Jacks 39 represent generally any suitable mechanism for adjusting the angle of incline. For example, a ratcheting jack, a scissor lift, a hydraulic cylinder or a lead screw could be used to raise and lower the conveyor belt. Or, stanchions 31 and 32 could be configured as telescoping jack stands, in which case the conveyor belt would be raised or lowered manually into the desired jack stand/incline setting.

Figure 6:
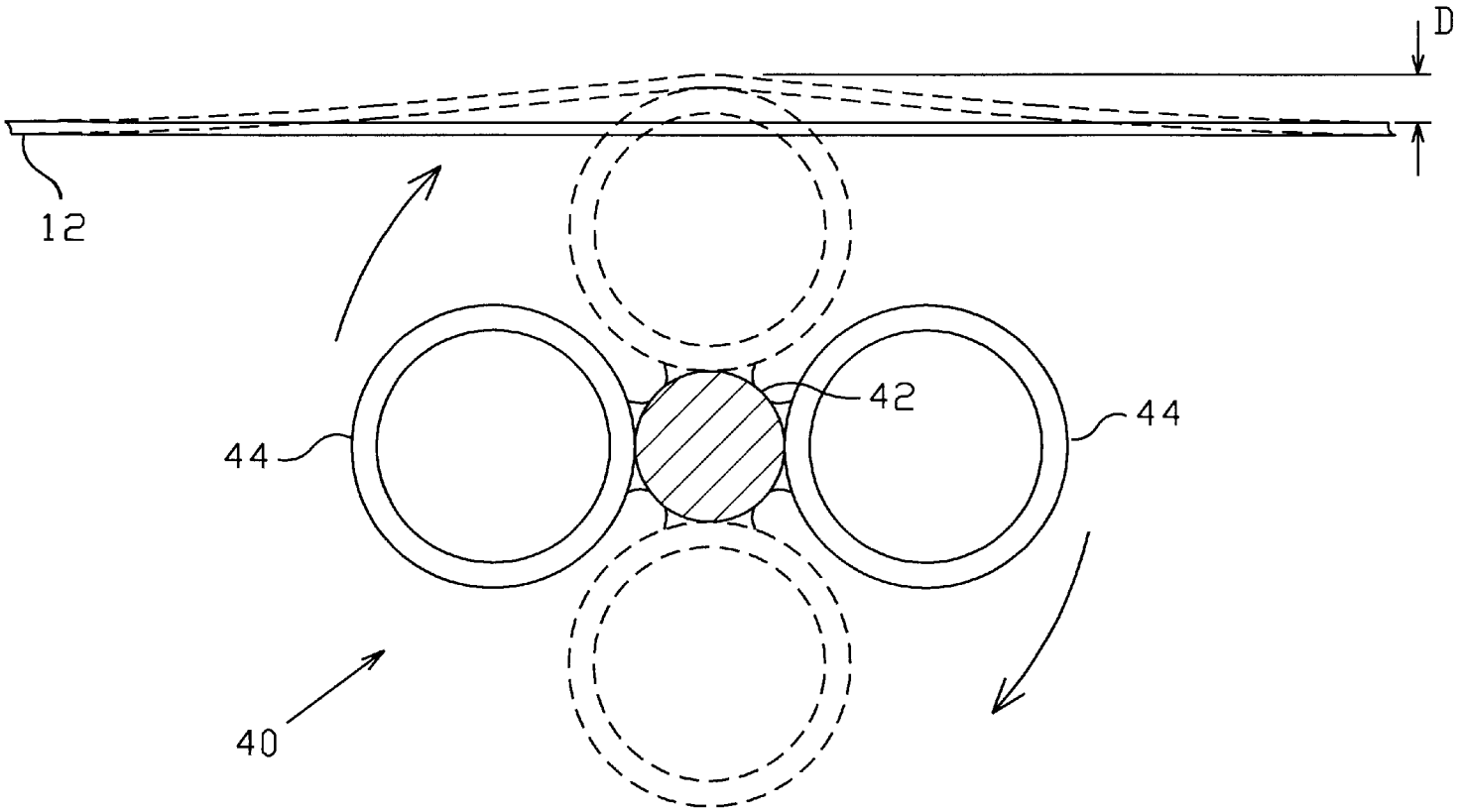
FIG. 6 is a cross section detail view of the agitator shown in FIGS. 1, 3, 4 and 5, wherein the agitator has a pair of opposing elongated lobes.
Figure 7:
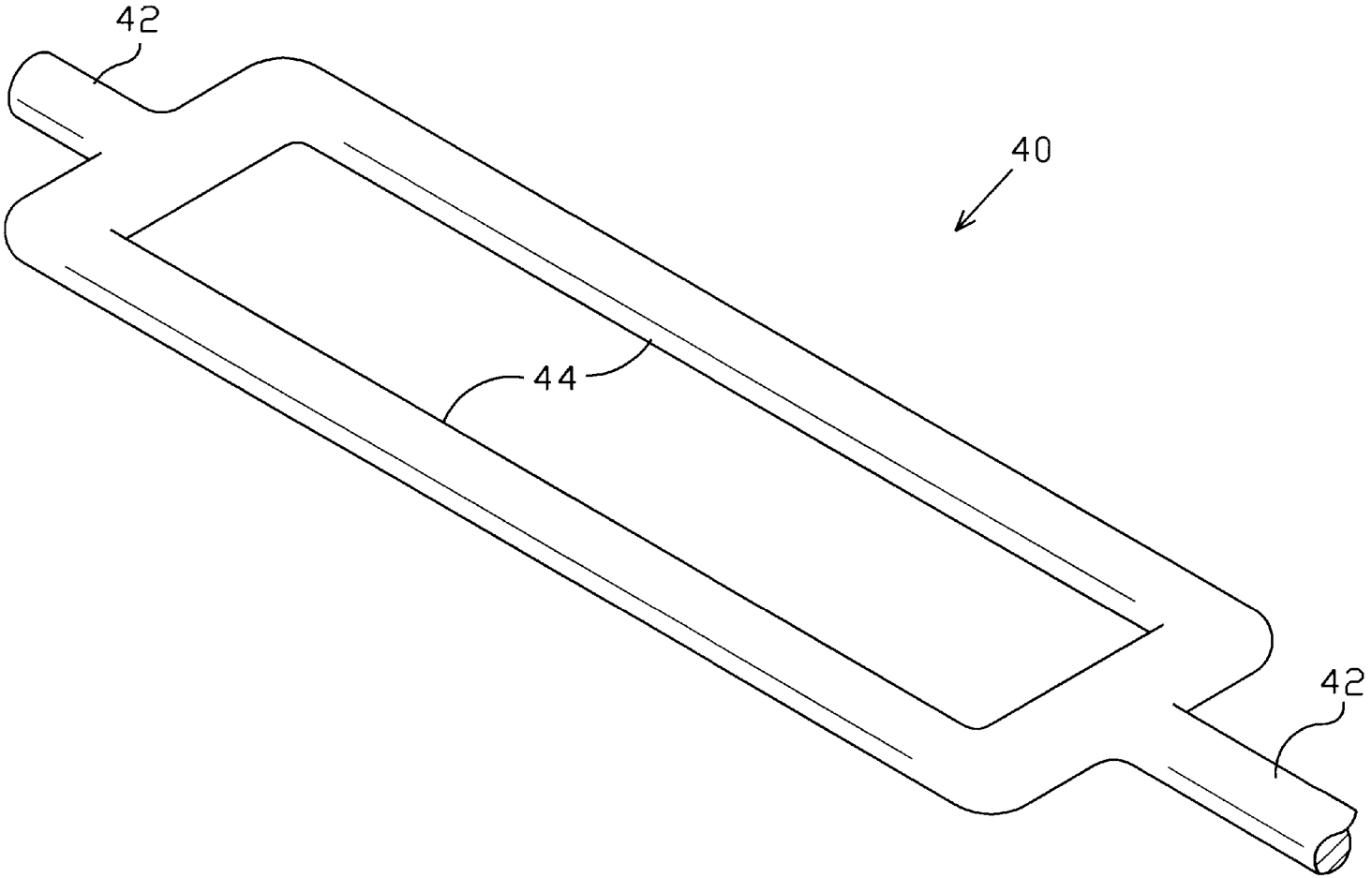
FIG. 7 is a perspective detail view of an alternative embodiment of the agitator, wherein the agitator shaft and the lobes are constructed as an integral unit.
Figure 8:
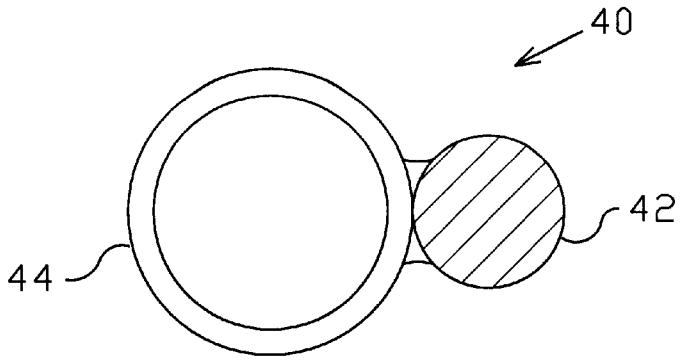
FIG. 8 is a cross section detail view of another embodiment of the agitator, wherein the agitator has a single elongated lobe.
Figure 9:
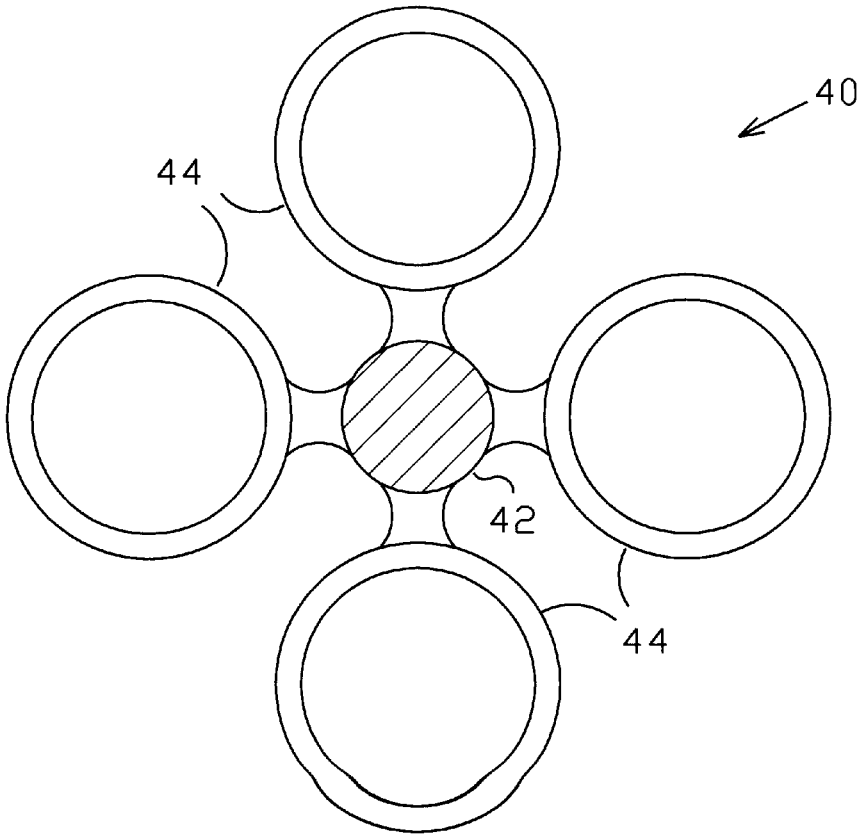
FIG. 9 is a cross section detail view of another embodiment of the agitator, wherein the agitator has a quad of elongated lobes.
Figure 10:
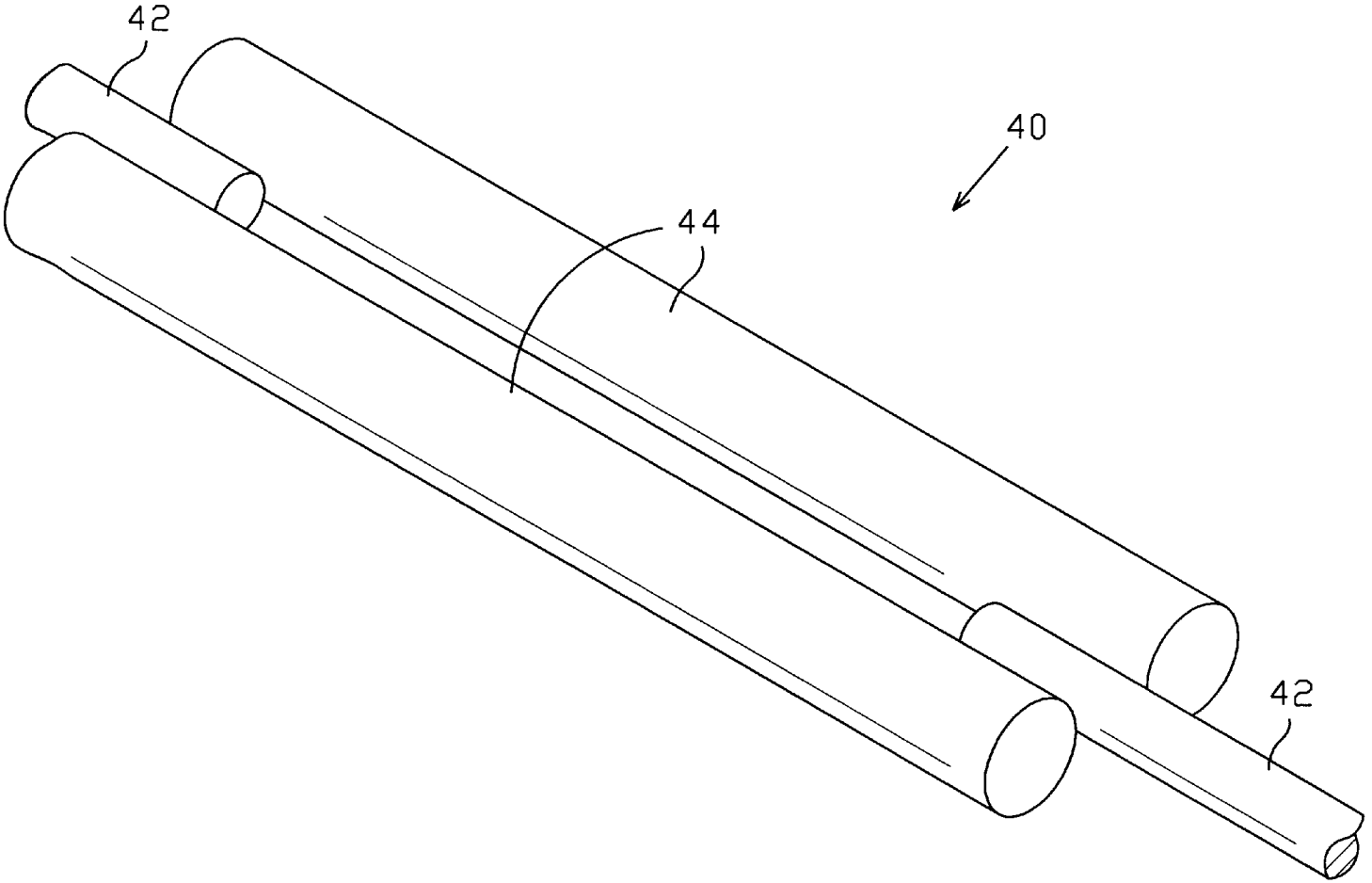
FIG. 10 is a perspective detail view of another embodiment of the agitator, wherein the agitator shaft is constructed as a series of discontinuous shaft segments.
Figure 11:
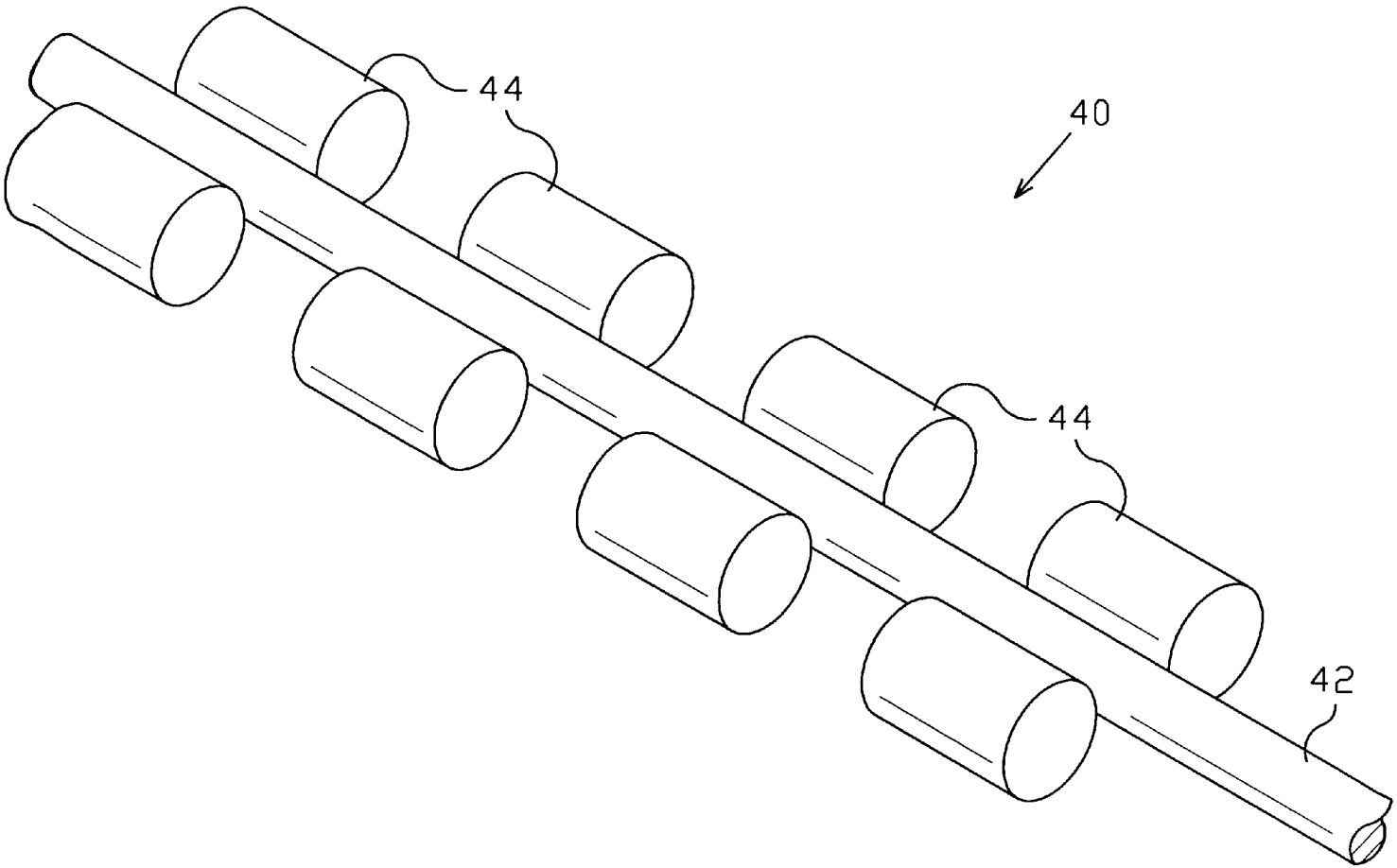
FIG. 11 is a perspective detail view of another embodiment of the agitator, wherein the agitator lobes are constructed as a series of discontinuous lobe segments.

Agitators 40 are mounted to and extend between stringers 36 under the upper reach 12*a* of conveyor belt 12. Each suction plenum 14 is positioned downstream of an agitator 40. Preferably, a pair of suction plenums 14 are positioned opposite one another on the upstream and downstream sides of each agitator 40. Agitators 40 consist of an agitator shaft 42 and a pair of elongated lobes 44 on shaft 42. Shaft 42 is mounted at each end to stringers 36 through a bearing, bushing or the like so that shaft 42 can be rotated under conveyor belt 12. Lobes 44 extend across substantially the full width of conveyor belt 12. Agitators 40 are positioned so that, upon rotation of shaft 42, lobes 44 intermittently bump conveyor belt 12, as shown in FIG. 6. Shaft 42 and lobes 44 can be constructed as discrete components, as shown in FIGS. 1–6, or as an integral unit as shown in FIG. 7. Although agitator 40 is shown with a pair of opposing elongated lobes 44, other configurations are possible. For example, and referring to FIGS. 8 and 9, a single lobe (FIG. 8) or a quad of lobes (FIG. 9) could be used. Preferably, shaft 42 extends continuously between stringers 36. Alternatively, shaft 42 may be constructed as a series of two or more shaft segments 42*a* as shown in FIG. 10. Preferably, lobes 44 extend continuously across substantially the full width of conveyor belt 12. Alternatively, lobes 44 may be constructed as a series of two or more lobe segments 44*a* as shown in FIG. 11.

Figure 4:
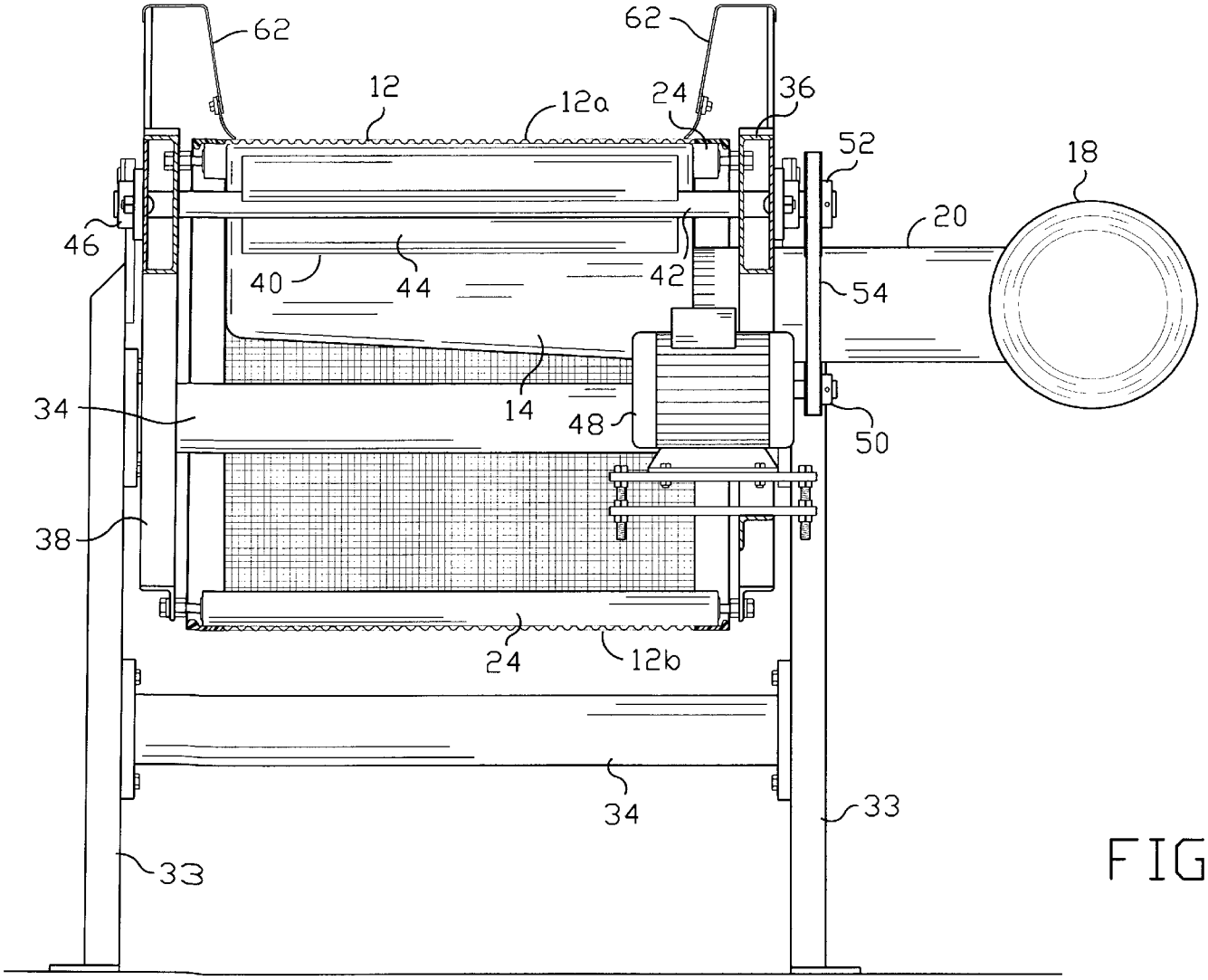
FIG. 4 is an elevation cross section view taken along the line 4—4 in FIG. 1.
Figure 5:
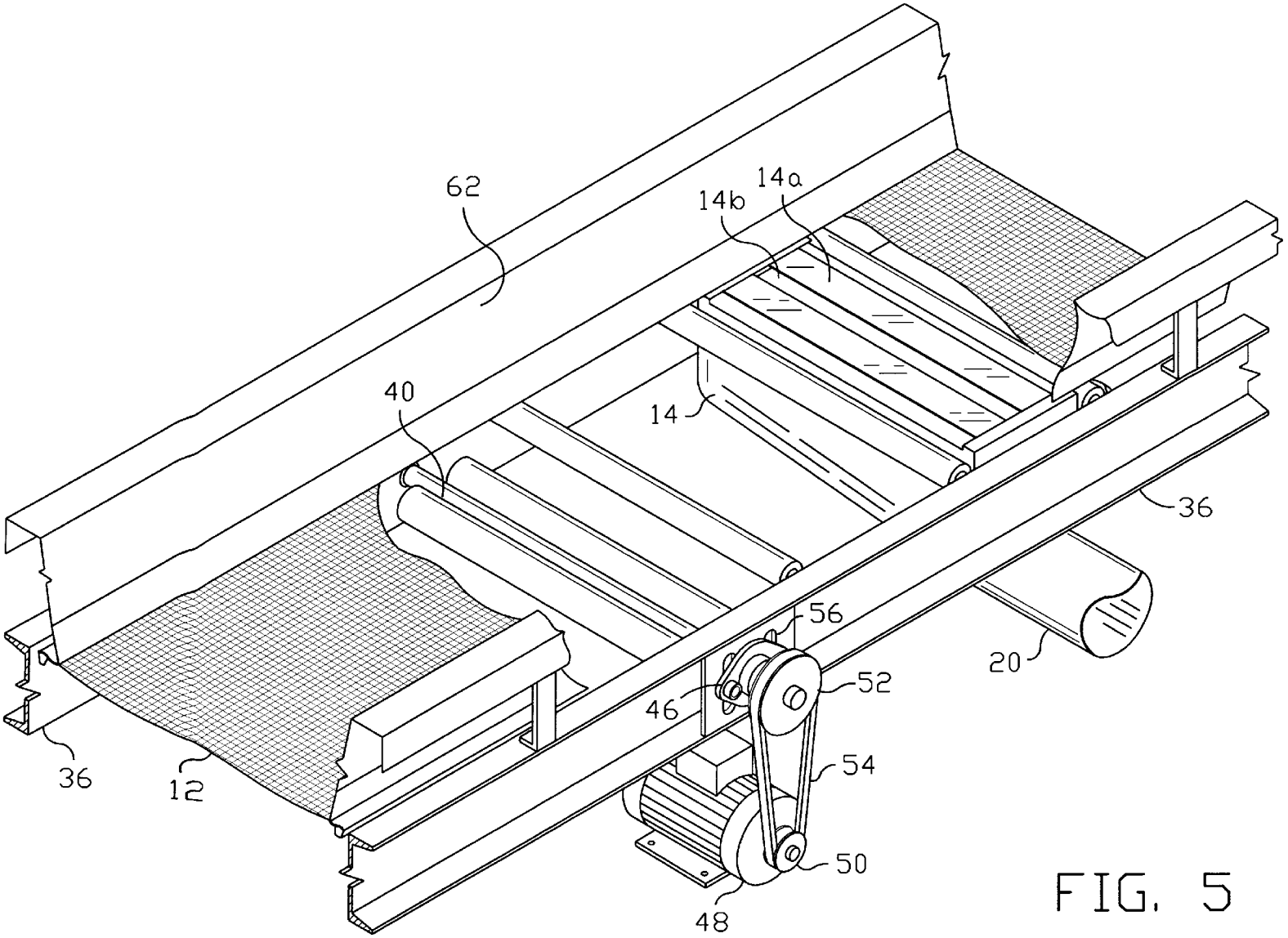
FIG. 5 is a detail perspective view of the agitator, the downstream plenum and the mounting details.

Referring to FIGS. 4 and 5, agitator shaft 42 turns in flange bearing 46. Flange bearing 46 is bolted to stringer 36. A variable speed motor 48 is mounted to frame 30 below agitator 40. A driving pulley 50 on motor 48 is operatively coupled to a driven pulley 52 on shaft 42 through a drive belt 54. Any suitable combination of belts, chains, pulleys, sprockets and/or gears may be used to construct the operative drive train connection between motor 48 and agitator shaft 42. Flange bearing 46 is bolted through slots 56 in stringers 36. The position of agitator 40 relative to conveyor belt 12 can be changed by moving shaft 42 up or down in slots 56. Thus, slots 56 serve as a simple adjustment mechanism that allows the operator to control the degree of deflection of conveyor belt 12 each time it is bumped by agitator lobes 44.

In operation, cut lettuce or some other food product is dumped on to the upstream end of conveyor belt 12. For products such as cut lettuce that have just been washed, catch basin 60 is provided to collect the large volume of water flushed on to the belt along with the lettuce. A sidewall barrier 62, best seen in FIG. 4, extends along the length of conveyor belt 12 to keep the lettuce from spilling off the sides of conveyor belt 12. As each agitator shaft 42 rotates, lobes 44 intermittently contact and deflect conveyor belt 12 a predetermined distance D, shown in FIG. 6. As the agitators intermittently deflect the conveyor belt, they jostle the lettuce carried on the conveyor belt as the air suction plenums suck the liquid off the jostled material. Air suction plenums 14 are positioned near enough to agitators 40 to draw a suction on the jostled lettuce.

For drying comparatively fragile food products such as cut lettuce, agitator shaft 42 should be rotated between about 100 and 500 revolutions per minute. Preferably, lobes 44 will deflect conveyor belt 12 a distance, D, between ¼ and 1 inches. Blower 16 develops a negative pressure in the range of 4–14 inches of water in air suction plenums 14. It is expected that the optimum settings for the rate of rotation of agitator shaft 42, deflection D of belt 12, and the negative pressure in plenums 14 will be determined empirically for each liquid removal application. Although the exact mechanism through which the jostling action facilitates drying is not known, it is believed that (1) water is knocked off the lettuce and (2) more surface area on the lettuce is exposed to the vacuum exerted by air suction plenums 14. Preferably, conveyor belt 12 is inclined at an angle of up to 8° so that the lettuce flows slightly uphill. It is believed that, as the lettuce is jostled on its up hill travel, it falls back down on itself to further improve dewatering.

Conveyor belt 12 may be made of any liquid permeable perforated type flexible belt material. This material need only be sufficiently flexible and durable to withstand the bumping action of agitator 40 and, of course, have a mesh/screen size suitable to separate the liquid and the product from which the liquid is being removed. The components of frame 30 and agitators 40 may be made of any structurally stable material, such as plastic, aluminum or steel rods, pipes, plates, channels and angles.

The invention is not limited to the several embodiments shown on the drawings and described above. The agitator, for example, might be made to reciprocate straight up and down like a piston, rather than rotating on a shaft. Nor is the invention limited to the removal of water from lettuce. The invention might be used for other food products and other liquids—the removal of oil from par fried potatoes, for instance. Therefore, it is to be understood that the liquid removal system of the present invention, which utilizes a vertically movable agitator and an air suction plenum to remove liquid from material carried on a conveyor belt, may be variously embodied to practice within the scope and spirit of the invention as defined in the following claims.

What is claimed is:

1. A liquid removal conveyor system, comprising:

a. a liquid permeable conveyor belt;

b. a vertically movable agitator, the agitator disposed below and adjacent to the conveyor belt so that, when the agitator moves up and down, the agitator intermittently deflects the conveyor belt; and c. an air suction plenum disposed below and adjacent to the conveyor belt near the agitator.

2. A system according to claim 1, wherein the agitator comprises an elongated member extending across substantially the full width of the belt.

3. A system according to claim 2, wherein the elongated member comprises a single continuous member.

4. A system according to claim 2, wherein the elongated member comprises a plurality of discontinuous segments.

5. A liquid removal conveyor system, comprising:

a. a liquid permeable conveyor belt;

b. a vertically movable agitator, the agitator disposed below and adjacent to the conveyor belt so that, when the agitator moves up and down, the agitator intermittently deflects the conveyor belt; and c. first and second air suction plenums disposed below and adjacent to the conveyor belt near the agitator, the first air suction plenum positioned upstream of the agitator and the second air suction plenum positioned downstream of the agitator.

6. A liquid removal conveyor system, comprising:

a. a liquid permeable conveyor belt;

b. an agitator comprising a rotatable shaft and a lobe attached to the shaft, the agitator disposed below and adjacent to the conveyor belt so that, upon rotation of the shaft, the lobe intermittently deflects the conveyor belt; and c. an air suction plenum disposed below and adjacent to the conveyor belt near the agitator.

7. A system according to claim 6, wherein the lobe comprises an elongated lobe extending across substantially the full width of the conveyor belt.

8. A system according to claim 7, wherein the elongated lobe comprises a single continuous member.

9. A system according to claim 7, wherein the elongated lobe comprises a plurality of discontinuous segments.

10. A system according to claim 6, wherein the shaft and the lobe are formed as an integral unit.

11. A system according to claim 6, wherein the lobe is a discrete component mounted to the shaft.

12. A system according to claim 6, further comprising a pair of lobes attached to the shaft opposite one another.

13. A system according to claim 6, wherein the shaft is continuous across the full width of the conveyor belt.

14. A system according to claim 6, wherein the shaft comprises a plurality of shaft segments.

15. A system according to claim 6, further comprising a motor operatively coupled to the shaft.

16. A system according to claim 6, wherein the shaft is mounted to an adjustable support member operative to vary the vertical position of the shaft in relation to the conveyor belt.

17. A system according to claim 1, wherein the agitator is configured to deflect the belt between ¼ inch and 1 inch.

18. A system according to claim 1, wherein the belt is inclined at an angle between 1° and 8° above horizontal.

19. A method for removing liquid from material moving along a liquid permeable conveyor belt, comprising the steps of:

a. intermittently deflecting the conveyor belt to jostle the material on the conveyor belt; and b. applying a suction to the conveyor belt in close proximity to the jostled material.

20. A method according to claim 19, wherein the step of intermittently deflecting comprises deflecting the conveyor belt between ¼ inch and 1 inch.

21. A method according to claim 19, wherein the step of intermittently deflecting comprises providing a rotatable agitator immediately below the conveyor belt and rotating the agitator between 100 revolutions per minute and 500 revolutions per minute.

22. A method according to claim 19, wherein the step of applying a suction comprises applying a first suction immediately upstream from a location of deflecting the belt and applying a second suction immediately downstream from the location of deflecting the belt.

23. A method according to claim 19, wherein the step of applying a suction comprises applying a suction between 4 inches of water and 14 inches of water.

24. A method according to claim 19, further comprising the step of inclining the conveyor belt at an angle between 1° and 8° above horizontal.

* * * * *